US006335719B1

(12) United States Patent
An et al.

(10) Patent No.: US 6,335,719 B1
(45) Date of Patent: Jan. 1, 2002

(54) METHOD AND APPARATUS FOR DRIVING LIQUID CRYSTAL PANEL IN DOT INVERSION

(75) Inventors: Kil Bum An; Bem Jin Moon, both of Anyang-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/347,813

(22) Filed: Jul. 2, 1999

(30) Foreign Application Priority Data

Jul. 4, 1998 (KR) ..... 98-27035

(51) Int. Cl.[7] ..... G09G 3/36
(52) U.S. Cl. ..... 345/98; 345/96
(58) Field of Search ..... 345/87, 94, 96, 345/98, 99, 209

(56) References Cited

U.S. PATENT DOCUMENTS 4,842,371 A * 6/1989 Yasuda et al. ..... 350/333
5,648,793 A * 7/1997 Chen ..... 345/96
5,886,679 A * 3/1999 Matsuda et al. ..... 349/33
6,020,870 A * 2/2000 Takahashi et al. ..... 345/92
6,075,507 A * 6/2000 Miyahara et al. ..... 345/89

* cited by examiner

*Primary Examiner*—Bipin Shalwala
*Assistant Examiner*—Nitin Patel
(74) *Attorney, Agent, or Firm*—Long Aldridge & Norman, LLP

(57) ABSTRACT

A liquid crystal panel driving apparatus is adaptive for stably keeping a picture quality independently of a picture pattern and improving a picture quality. In the apparatus, the liquid crystal panel arranged with liquid crystal cells is divided into a number of polarity blocks. Each one of the liquid crystal cells included in each block responds to data signals having polarities contrary to data signals applied to the adjacent liquid crystal cells and responds to data signals having polarities contrary to data signals applied to the liquid crystal cells included in the adjacent blocks. The polarities of data signals applied to all the liquid crystal cells in the liquid crystal panel are inverted every frame interval.

28 Claims, 5 Drawing Sheets

FIG. 1
PRIOR ART

| | | | | | | | | | | | | | | | | | | | |
|---|---|---|---|---|---|---|---|---|---|---|---|---|---|---|---|---|---|---|---|
| + | − | + | − | + | − | + | − | + | − | + | − | + | − | + | − | + | − | + | − |
| − | + | − | + | − | + | − | + | − | + | − | + | − | + | − | + | − | + | − | + |
| + | − | + | − | + | − | + | − | + | − | + | − | + | − | + | − | + | − | + | − |
| − | + | − | + | − | + | − | + | − | + | − | + | − | + | − | + | − | + | − | + |
| + | − | + | − | + | − | + | − | + | − | + | − | + | − | + | − | + | − | + | − |
| − | + | − | + | − | + | − | + | − | + | − | + | − | + | − | + | − | + | − | + |
| + | − | + | − | + | − | + | − | + | − | + | − | + | − | + | − | + | − | + | − |
| − | + | − | + | − | + | − | + | − | + | − | + | − | + | − | + | − | + | − | + |
| + | − | + | − | + | − | + | − | + | − | + | − | + | − | + | − | + | − | + | − |
| − | + | − | + | − | + | − | + | − | + | − | + | − | + | − | + | − | + | − | + |

FIG. 2
PRIOR ART

| | | | | | | | | | | | | | | | | | | | |
|---|---|---|---|---|---|---|---|---|---|---|---|---|---|---|---|---|---|---|---|
| − | + | − | + | − | + | − | + | − | + | − | + | − | + | − | + | − | + | − | + |
| + | − | + | − | + | − | + | − | + | − | + | − | + | − | + | − | + | − | + | − |
| − | + | − | + | − | + | − | + | − | + | − | + | − | + | − | + | − | + | − | + |
| + | − | + | − | + | − | + | − | + | − | + | − | + | − | + | − | + | − | + | − |
| − | + | − | + | − | + | − | + | − | + | − | + | − | + | − | + | − | + | − | + |
| + | − | + | − | + | − | + | − | + | − | + | − | + | − | + | − | + | − | + | − |
| − | + | − | + | − | + | − | + | − | + | − | + | − | + | − | + | − | + | − | + |
| + | − | + | − | + | − | + | − | + | − | + | − | + | − | + | − | + | − | + | − |
| − | + | − | + | − | + | − | + | − | + | − | + | − | + | − | + | − | + | − | + |
| + | − | + | − | + | − | + | − | + | − | + | − | + | − | + | − | + | − | + | − |

METHOD AND APPARATUS FOR DRIVING LIQUID CRYSTAL PANEL IN DOT INVERSION

This application claims the benefit of Korean Patent Application No. P98-27035, filed on Jul. 4, 1998, which is hereby incorporated by reference.

BACKGROUND OF THE INVENTION

1. Field of the Invention

This invention relates to a technique for driving a liquid crystal panel in a liquid crystal display device, and more particularly to a liquid crystal panel driving method for driving a liquid crystal panel in a dot inversion system and an apparatus thereof.

2. Description of the Related Art

Generally, a liquid crystal display device controls the light transmissivity of liquid crystal cells in a liquid crystal panel to display a picture corresponding to a video signal. Such a liquid crystal display device uses three driving methods, such as a frame inversion system, a line inversion system and a dot inversion system, so as to drive the liquid crystal cells in the liquid crystal panel.

In a liquid crystal panel driving method of the frame inversion system, polarities of data signals applied to the liquid crystal cells are inverted whenever the frame is changed. In a liquid crystal panel driving method of the line inversion system, polarities of data signals applied to the liquid crystal cells are inverted in accordance with lines on the liquid crystal panel, that is, gate lines. In a liquid crystal panel driving method of the dot inversion system, data signals having polarities contrary to the adjacent liquid crystal cells on the gate lines and to the adjacent liquid crystal cells on the data lines are applied to each liquid crystal cell in the liquid crystal panel, and the polarities of data signals applied to all liquid crystal cells in the liquid crystal panel are inverted every frame. In other words, in the dot inversion system, data signals are applied to the liquid crystal cells in the liquid crystal panel in such a manner that the positive (+) polarity and the negative (−) polarity appear alternately, as shown in FIG. 1, as the data signals go from the liquid crystal cell at the left upper end into the liquid crystal cells at the right side and into the liquid crystal cells at the lower side when a video signal in the odd-numbered frame is displayed; while data signals are applied to the liquid crystal cells in the liquid crystal panel in such a manner that the positive (+) polarity and the negative (−) polarity appear alternately, as shown in FIG. 2, as the data signals go from the liquid crystal cell at the left upper end into the liquid crystal cells at the right side and into the liquid crystal cells at the lower side when a video signal in the even-numbered frame is displayed.

The dot inversion system in the above three liquid crystal panel driving methods allows data signals having polarities contrary to data signals applied to the liquid crystal cells adjacent in the vertical and horizontal direction to be applied to certain liquid crystal cells, and thus provides a better quality of picture compared with the frame and line inversion systems. Due to this advantage, a liquid crystal driving method of the dot inversion system has been mainly used in the industry.

However, a specific pattern, for example, a check pattern, a subpixel pattern or a windows shut-down mode pattern, may be displayed when the liquid crystal panel driving method of the dot inversion system is used. In this case, a frame inversion effect appears in the liquid crystal panel driving method of dot inversion. Depending on the images being displayed, a flicker may be generated and the picture quality is deteriorated in a picture displayed by the liquid crystal panel driving method of the dot inversion system. For example, when a potential difference between data signals applied to liquid crystal cells indicated with the oblique lines and the remaining cells in the liquid crystal cells in the liquid crystal panel as shown in FIG. 3 is large, only liquid crystal cells indicated with the oblique lines are assumed to be driven in a pattern having the polarities inverted every frame. In other words, only liquid crystal cells indicated with the oblique lines in FIG. 3 seem to be driven with the frame inversion system. Due to this, in the liquid crystal panel driving method of the dot inversion system, a flicker noise emerging on the screen is dictated by a picture pattern. As a result, the picture quality displayed by the liquid crystal panel driving method of the dot inversion system is inconsistent.

SUMMARY OF THE INVENTION

Accordingly, it is an object of the present invention to provide a liquid crystal panel driving method and apparatus that is adaptive for stably keeping picture quality independently of a picture pattern as well as improving picture quality.

In order to achieve these and other objects of the invention, a liquid crystal panel driving method according to one aspect of the present invention includes the steps of dividing a liquid crystal panel into a plurality of blocks; responding liquid crystal cells included in each block to data signals having polarities contrary to the adjacent liquid crystal cells; responding to each of the liquid crystal cells included in each block are data signals having polarities contrary to data signals applied to the liquid crystal cells included in the adjacent blocks; and responding in all liquid crystal cells in the liquid crystal panel are data signals having opposite polarities every predetermined interval.

A liquid crystal panel driving apparatus according to another aspect of the present invention includes signal coupling means for applying data signals to the liquid crystal panel in such a manner that the liquid crystal cells are driven by one line unit; and polarity control means for controlling the data signals applied to the liquid crystal panel in such a manner that the liquid crystal panel is divided into a plurality of blocks and that each block responds to data signals having polarities contrary to the data signals applied to the adjacent blocks.

A liquid crystal display device according to still another aspect of the present invention includes a liquid crystal panel having picture elements and transistors connected to each of the picture elements, said picture elements being positioned at intersections in which a plurality of gate lines cross a plurality of source lines; a gate driver, connected to the plurality of gate lines, for sequentially applying a scanning signal to the gate lines; and a source driver for supplying data voltages to the plurality of source lines in such a manner that the liquid crystal panel is divided into a plurality of blocks, that the polarities of data voltages applied to the picture elements adjacent to each other in the horizontal and vertical direction within each block are contrary to each other, and that a polarity arrangement of the data voltages applied between the blocks adjacent in the horizontal and vertical direction is contrary to each other.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

These and other objects of the invention will be apparent from the following detailed description of the embodiments of the present invention with reference to the accompanying drawings, in which:

FIGS. 1 to 3 illustrate polarity patterns of data signals applied to liquid crystal cells in the liquid crystal panel by a liquid crystal panel driving method of a dot inversion system;

DETAILED DESCRIPTION OF THE PREFERRED EMBODIMENTS

Figure 3:
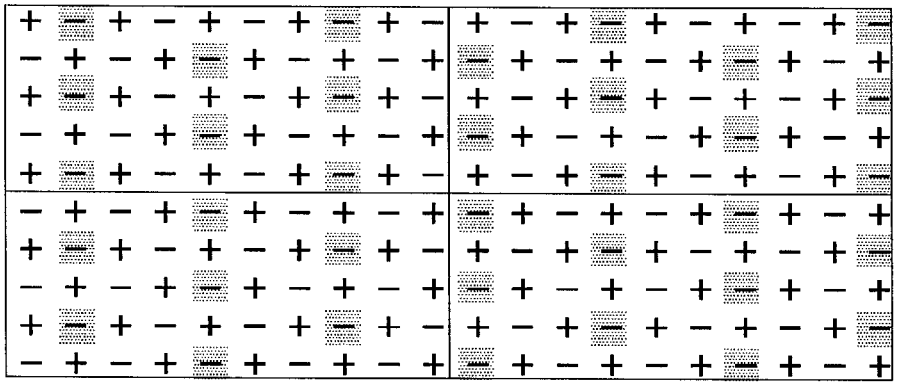
FIG.3 PRIOR ART
Figure 4:
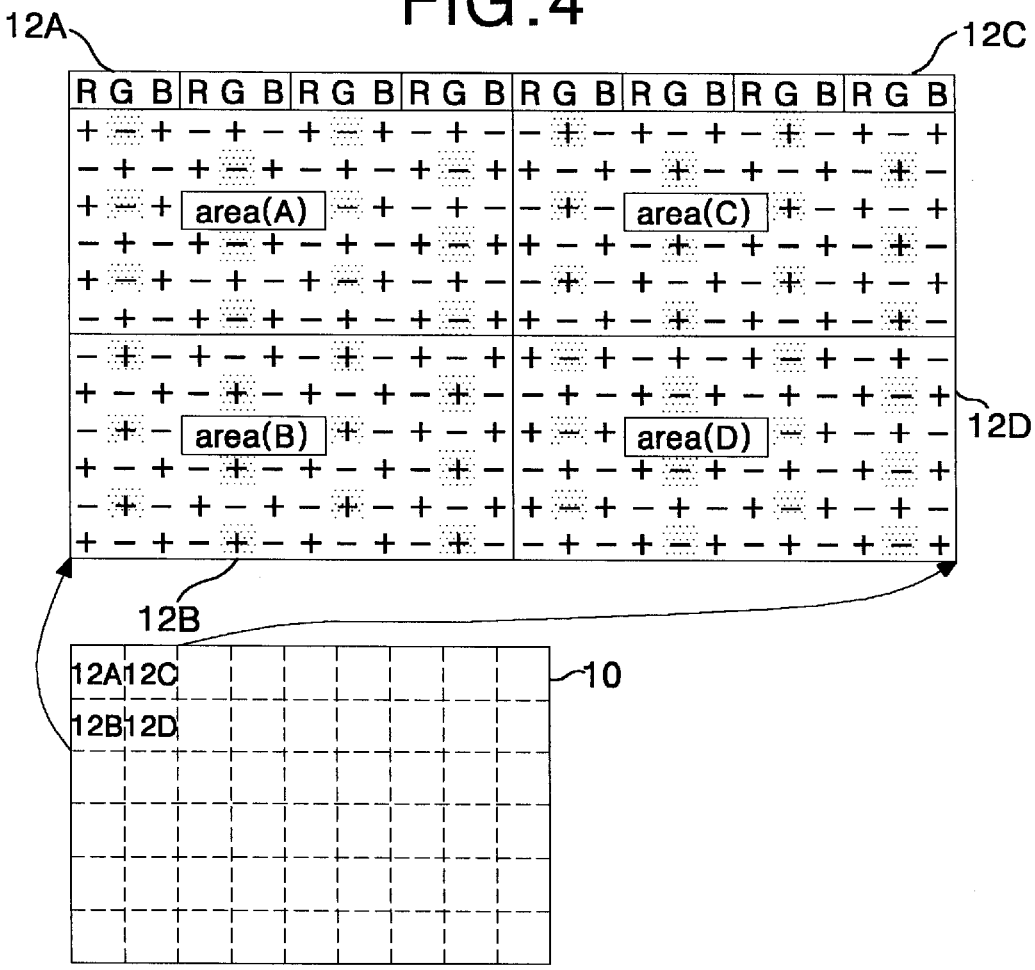
FIGS. 4 and 5 illustrate polarity patterns of data signals applied to liquid crystal cells in the liquid crystal panel by a liquid crystal panel driving method according to an embodiment of the present invention.
Figure 5:
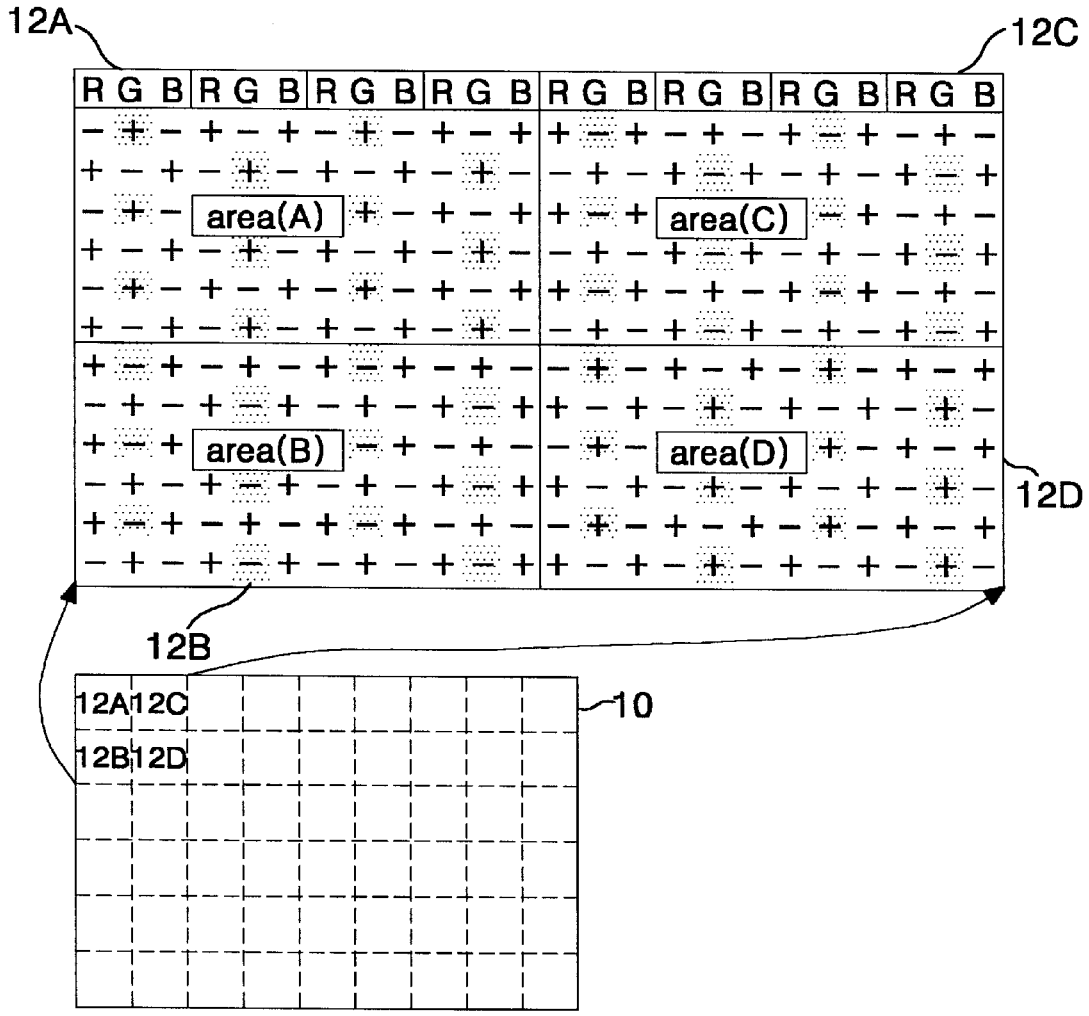

FIGS. 4 and 5 are views for explaining a liquid crystal panel driving method according to an embodiment of the present invention. In FIGS. 4 and 5, a liquid crystal panel 10 having liquid crystal cells arranged in a matrix pattern is divided into a number of blocks. Each block preferably includes the same number of liquid crystal cells. The liquid crystal cells included in each block are driven with data signals having polarities contrary to the liquid crystal cells adjacent in the up, down, left and right directions.

The liquid crystal cells included in each block are driven with data signals having opposite polarities to data signals applied to the liquid crystal cells included in the blocks adjacent in the up, down, left and right directions. Accordingly, the liquid crystal cells positioned at the edges of each block are coupled with data signals having the same polarities as the liquid crystal cells positioned at the edges of the blocks located diagonally therefrom. For example, a data signal applied to the first liquid crystal cell in the first block 12A in FIG. 4 has the same polarity as a data signal applied to the first liquid crystal cell in the fourth block 12D, but has the opposite polarity compared to the first liquid cell in the second and third blocks 12B and 12C. The first liquid crystal cell in the second block 12B has the same polarity as a data signal applied to the first liquid crystal cell in the third block 12C but has the opposite polarity compared to the first liquid cell in the first and fourth blocks 12A and 12D. In addition, the second liquid crystal cell positioned at the second line in the first block 12A receives a data signal having the polarity (e.g., positive polarity (+)) contrary to those (e.g., negative polarity (−)) of data signals applied to four liquid crystal cells adjacent in the up, down, left and right directions. Data signals applied to the liquid crystal cells included in the first to fourth blocks 12A to 12D in FIG. 4 have the inverted polarities as shown in FIG. 5 as the frame is changed. As a result, in the liquid crystal panel driving method according to the present invention, the polarities of data signals applied to the liquid crystal cells in the liquid crystal panel are inverted every frame, every block and every dot.

As described above, in the liquid crystal panel driving method according to the present invention, the polarities of data signals are inverted every frame, every block and every dot so that the liquid crystal panel is not driven by the frame inversion system. Accordingly, even when a specific pattern, such as a check pattern, subpixel pattern and windows shut-down mode pattern, is displayed, a flicker noise is reduced and, further, picture quality can be stably maintained independently of a pattern of a picture.

Figure 6:
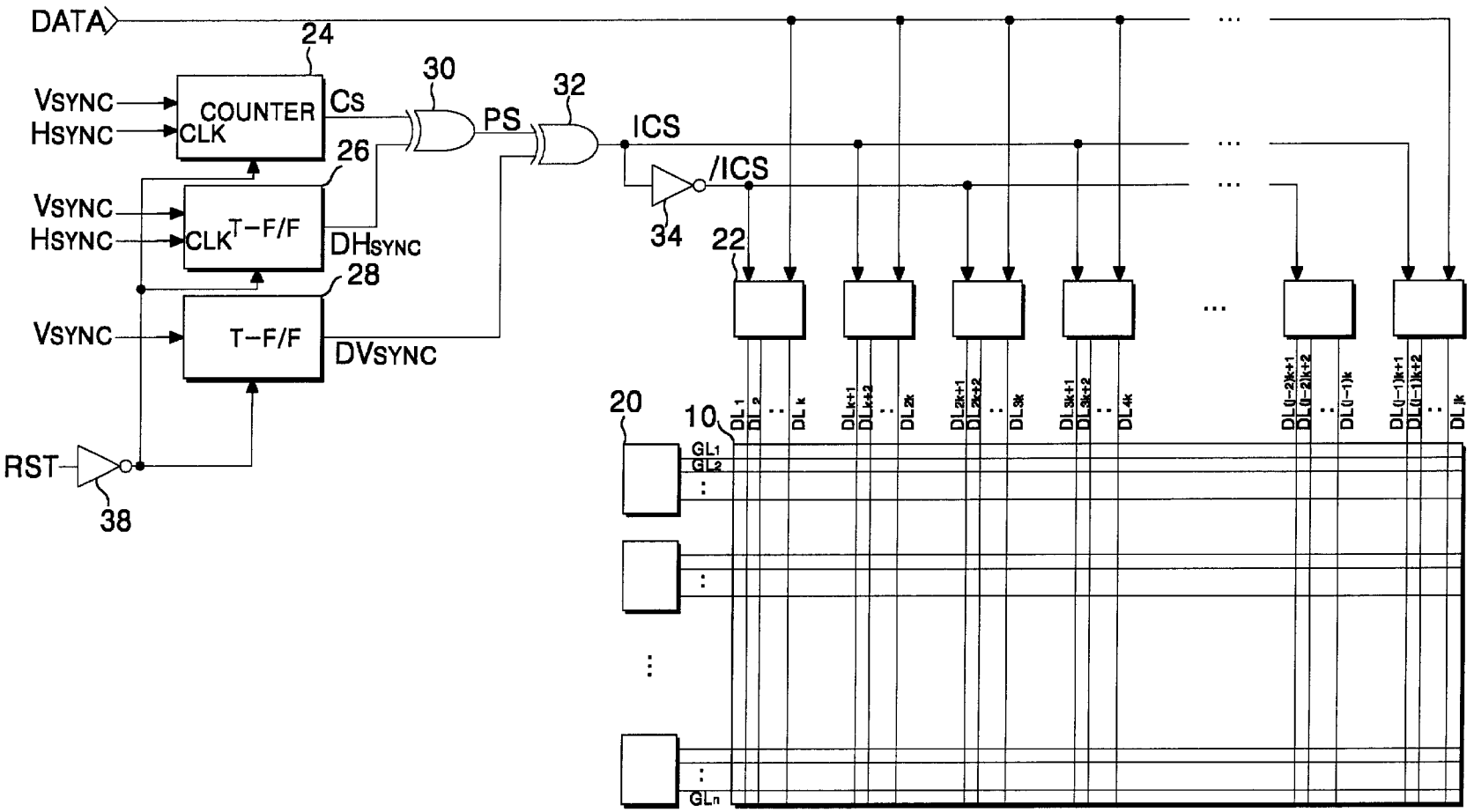
FIG. 6 is a schematic block diagram showing the configuration of a liquid crystal panel driving apparatus according to an embodiment of the present invention.

Referring now to FIG. 6, there is shown a liquid crystal panel driving apparatus according to an embodiment of the present invention. The liquid crystal panel driving apparatus includes gate driving integrated circuits (ICs) 20 for divisionally driving n gate lines GL1 to GLn on a liquid crystal panel 10, and j data driving ICs 22 for divisionally driving m data lines DL1 to DLm on the liquid crystal panel 10. Each data driving IC 22 drives k data lines. The liquid crystal panel 10 is provided with a number of liquid crystal cells and thin film transistors (TFTs) for switching data signals applied to each liquid crystal cell. The number of liquid crystal cells is installed at the intersections in which the data lines DL1 to DLm cross the gate lines GL1 to GLn, and the TFTs also are positioned at the intersections. The gate driving ICs 20 apply a gate drive pulse to n gate lines GL1 to GLn on the liquid crystal panel 10 sequentially to drive the n gate lines GL1 to GLn sequentially. Then, the TFTs in the liquid crystal panel 10 are sequentially driven for one gate line to apply data signals to liquid crystal cells for one gate line sequentially. Each of the j data driving ICs 22 applies k data signals to the k data lines DL1 to DLk whenever the gate drive pulse is generated. The k data signals generated at each data driving IC 22 have polarities alternated in accordance with an arrangement sequence of the adjacent data lines. Also, the k data signals generated at each data driving IC 22 have polarities that change alternately as the frame progresses.

Figure 7:
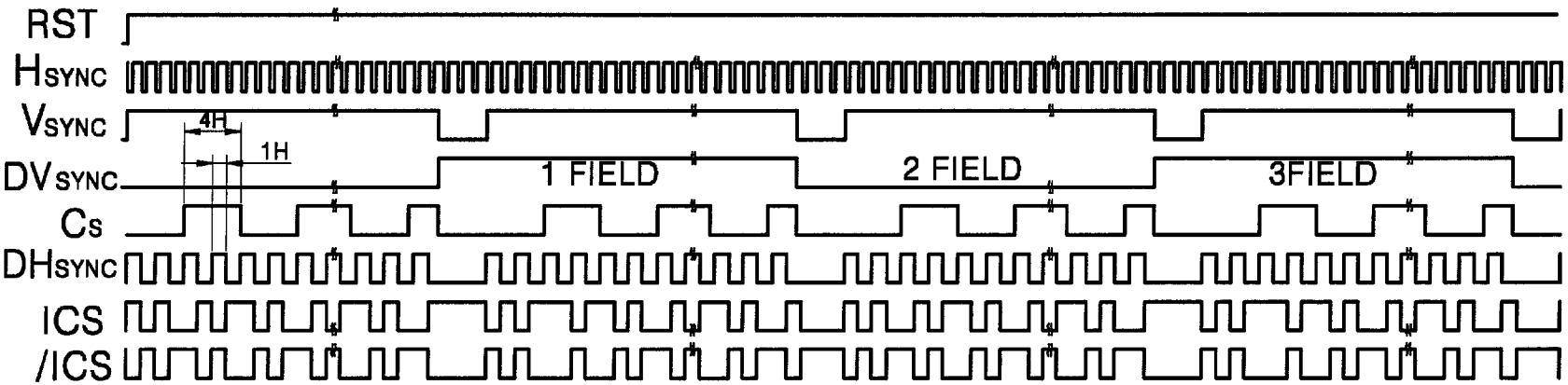
FIG. 7 is an operational timing diagram in each part of the liquid crystal panel driving apparatus shown in FIG. 6.

The liquid crystal driving apparatus further includes a counter 24, a first toggle flip-flop 26 and a second toggle flip-flop 28 for commonly receiving a vertical synchronizing signal Vsync. The counter 24 is initialized in a blanking interval of the vertical synchronizing signal Vsync as shown in FIG. 7, and performs a count operation with a horizontal synchronizing signal Hsync applied to its clock terminal CLK in a vertical scanning interval of the vertical synchronizing signal Vsync. At the time of a count operation, with the aid of the horizontal synchronizing signal Hsync to generate a carry signal Cs having a waveform in which the horizontal synchronizing signal Hsync is frequency-divided into a certain integer, the counter 24 repeatedly counts until a certain integer is reached (e.g., $\alpha$=4). In a similar manner, the first toggle flip-flop 26 is initialized in the blanking interval of the vertical synchronizing signal Vsync while performing a toggle operation in the scanning interval of the vertical synchronizing signal Vsync. During the scanning interval of the vertical synchronizing signal Vsync, the first toggle flip-flop 26 inverts a logic state of an output signal whenever the horizontal synchronizing signal Hsync is inputted to its clock terminal CLK. Accordingly, the first toggle flip-flop 26 generates a two-frequency-divided horizontal synchronizing signal DHsync, as shown in FIG. 7, inverted every horizontal synchronous period during the vertical scanning interval. The two-frequency-divided horizontal synchronizing signal DHsync generated at the first toggle flip-flop 26 is applied to a first exclusive OR gate 30.

The second toggle flip-flop 28 generates a two-frequency-divided vertical synchronizing signal DVsync, as shown in FIG. 7, having a logic state inverted every period of the vertical synchronizing signal Vsync. The two-frequency-divided vertical synchronizing signal DVsync generated at the second toggle flip-flop 28 is applied to a second exclusive OR gate 32.

The first exclusive OR gate 30 selectively inverts the two-frequency-divided horizontal synchronizing signal DHsync from the second toggle flip-flop 26 in accordance with a logic state of the carry signal Cs from the counter 24. In other words, the first exclusive OR gate 30 inverts the two-frequency-divided horizontal synchronizing signal DHsync only during a time interval when the carry signal Cs remains at a high logic state. Accordingly, the first exclusive OR gate 30 generates a pulse signal PS maintaining a high logic state or a low logic state in each interval corresponding to a certain time at the horizontal synchronous interval.

In a similar manner, the second exclusive OR gate 32 selectively inverts the pulse signal PS from the first exclusive OR gate 30 in accordance with a logic value of the two-frequency-divided vertical synchronizing signal DVsync from the second toggle flip-flop 28. In other words, the second exclusive OR gate 32 inverts the pulse signal PS only during a time interval when the two-frequency-divided vertical synchronizing signal DVsync remains at a high logic state. Accordingly, the second exclusive OR gate 32 generates an inversion control signal ICS, as shown in FIG. 7, in which the pulse signal PS is inverted at every vertical synchronous interval.

The inversion control signal ICS is commonly applied to the even-numbered data driving ICs in the k data driving ICs 22, and simultaneously applied to an inverter 34. The inverter 34 inverts the inversion control signal ICS from the second exclusive OR gate 32 as shown in FIG. 7, and applies the inverted inversion control signal /ICS to the odd-numbered data driving ICs 22 in the j data driving ICs 22. As a result, the counter 24, the first and second toggle flip-flops 26 and 28, the first and second exclusive OR gates 30 and 32 and the inverter 34 serve as inversion control means that generate the inversion control signal ICS and the inverted inversion control signal /ICS making use of the vertical and horizontal synchronizing signals Vsync and Hsync.

Depending on a logic state of the inversion control signal ICS, the even-numbered data driving ICs 22 receiving the inversion control signal ICS from the second exclusive OR gate 32 have the polarities inverted alternately along the vertical axis (i.e., the data lines), and have the same polarities as the previous gate line every certain number of gate lines along the vertical axis (i.e., the gate lines) and have alternate polarities at the remaining gate lines. Also, the even-numbered data driving ICs 22 generate k data signals at the k data lines $DL_{k+1}$ to $DL_{2k}$, $DL_{3k+1}$ to $DL_{4k}$, . . . , $DL_{(j-1)k+1}$ to $DL_m$ in such a manner that the polarities are inverted every frame interval along the time axis. In other words, each one of the even-numbered data driving ICs 22 inverts a polarity pattern of the data signals in such a manner to follow the blocks, in which the liquid crystal panel 10 is divided into a certain number of gate line units, along the vertical axis and to be alternated on a time basis. In a similar manner, depending on a logic state of the inverted inversion control signal /ICS, each of the odd-numbered data driving ICs 22 receiving the inverted inversion control signal /ICS from the inverter 34 has the polarities inverted alternately along the horizontal axis (i.e., the data lines), and has the same polarities as the previous gate line every certain number of gate lines along the vertical axis (i.e., the gate lines) and has alternate polarities at the remaining gate lines. Also, the odd-numbered data driving ICs 22 apply data signals to the k data lines $DL_{k+1}$ to $DL_{2k}$, $DL_{3k+1}$ to $DL_{4k}$, . . . , $DL_{(j-1)k+1}$ to $DL_m$ in such a manner as to have the polarities inverted every frame interval along the time axis and to have the polarities contrary to the data lines DL driven with the adjacent even-numbered data driving ICs 22. In other words, each of the odd-numbered data driving ICs 22 inverts a polarity pattern of the data signals in such a manner as to follow the blocks, in which the liquid crystal panel 10 is divided into a certain number of gate line units, along the vertical axis and to be alternated on a time basis, and, at the same time, in such a manner as to be opposite to the polarity patterns of data signals generated at the adjacent even-numbered data driving ICs 22. As a result, by the inversion control signal ICS and the inverted inversion control signal /ICS, the j data driving ICs 22 divide the liquid crystal panel 10 into blocks including liquid crystal cells corresponding to a product of a certain integer $\alpha$ by k, and drive the blocks in the dot inversion system in such a manner as to have a polarity pattern contrary to the adjacent blocks.

Accordingly, in the liquid crystal panel driving apparatus according to an embodiment of the present invention, a phenomenon of driving the liquid crystal panel in the frame inversion system does not appear and a flicker noise is sufficiently reduced or not generated, even when a picture having a specific pattern, such as a check pattern, subpixel pattern and windows shutdown mode pattern, is displayed. As a result, the liquid crystal panel driving apparatus, according to an embodiment of the present invention, is capable of stably maintaining the quality of a picture displayed on the liquid crystal panel independently of a pattern of a picture.

Moreover, the liquid crystal panel driving apparatus includes a second inverter 36 for receiving a reset signal RST. The second inverter 36 inverts the reset signal RST as shown in FIG. 7, and commonly applies the inverted reset signal to the counter 24 and the reset terminals of the first and second toggle flip-flops 26 and 28. The counter 24 and the first and second toggle flip-flops 26 and 28 responding to the inverted reset signal from the second inverter 26 are operated during a time interval when the reset signal RST remains at a high logic state. Also, the counter 24 and the first and second toggle flip-flops 26 and 28 initialize their outputs during a time interval when the reset signal RST remains at a low logic state.

The discrete components described in the embodiments of the present invention may be substituted with a programmable processor and a program code to operate the same. Alternatively, an application specific integrated circuit (ASIC) may also be used.

As described above, in the liquid crystal panel driving method and apparatus according to the present invention, a liquid crystal panel is driven in a different polarity pattern of data signals for each block in the dot inversion system, so that a phenomenon of driving the liquid crystal panel in the frame inversion system does not appear even though a picture having a specific pattern, such as a check pattern, subpixel pattern and windows shut-down mode pattern, etc., is displayed. Accordingly, the liquid crystal panel driving method and apparatus according to the present invention is capable of preventing the generation of a flicker noise independently of a pattern of a picture as well as providing a good quality of picture stably.

It will be apparent to those skilled in the art that various modifications and variation can be made in the present invention without departing from the spirit or scope of the invention. Thus, it is intended that the present invention covers the modifications and variations of this invention provided they come within the scope of the appended claims and their equivalents.

What is claimed is:

1. A method of driving a liquid crystal panel having liquid crystal cells, comprising the steps of:

grouping the liquid crystal panel into at least first and second blocks adjacent each other, the first block having at least two liquid crystal cells and including a first column and a last column, and the second block having at least two liquid crystal cells and including a first column and a last column, wherein the last column of the first block is adjacent the first column of the second block;

setting the liquid crystal cells in the first column and the last column of the first block to have alternating polarities, wherein polarities of corresponding rows of liquid crystal cells in the first and last columns are opposite to each other; and setting the liquid crystal cells in the first column of the second block to have the same polarities as the corresponding liquid crystal cells located in the last column of the first block.

2. The method of claim 1, setting the liquid crystal cells in the first column and the last column of the second block to have alternating polarities, wherein polarities of corresponding rows of liquid crystal cells in the first and last columns are opposite to each other.

3. The method of claim 2, wherein the polarities of the liquid crystal cells in the first and second blocks are switched at a predetermined interval.

4. The method of claim 3, wherein the predetermined interval is every frame.

5. The method of claim 1, wherein the polarities of the liquid crystal cells in the first block are switched at a predetermined interval.

6. The method of claim 5, wherein the predetermined interval is every frame.

7. The method of claim 5, wherein the predetermined interval is every field.

8. The method of claim 1, wherein the polarities of the liquid crystal cells in the second block are switched at a predetermined interval.

9. The method of claim 1, wherein the polarities of the liquid crystal cells in the first and second blocks are switched at a predetermined interval.

10. The method of claim 1, wherein each one of the first and second blocks includes at least two pixels, each pixel comprising liquid crystal cells corresponding to red, green, blue cells.

11. The method of claim 10, wherein each one of the first and second blocks includes at least twelve liquid crystal cell columns.

12. An apparatus for driving a liquid crystal panel having liquid crystal cells arranged in a matrix pattern, the apparatus comprising:

means for grouping the liquid crystal panel into at least first and second blocks adjacent to each other, the first block having at least two liquid crystal cells and including a first column and a last column, and the second block having at least two liquid crystal cells and including a first column and a last column, wherein the last column of the first block is adjacent the first column of the second block;

means for setting the liquid crystal cells in the first column and the last column of the first block to have alternating polarities, wherein polarities of corresponding rows of liquid crystal cells in the first and last columns are opposite to each other; and means for setting the liquid crystal cells in the first column of the second block to have the same polarities as the corresponding liquid crystal cells located in the last column of the first block.

13. The apparatus of claim 12, setting the liquid crystal cells in the first column and the last column of the second block to have alternating polarities, wherein polarities of corresponding rows of liquid crystal cells in the first and last columns are opposite to each other.

14. The apparatus of claim 12, wherein the polarities of the liquid crystal cells in the first block are switched at a predetermined interval.

15. The apparatus of claim 12, wherein the polarities of the liquid crystal cells in the second block are switched at every frame.

16. The apparatus of claim 12, wherein the polarities of the liquid crystal cells in the first and second blocks are switched at every frame.

17. The apparatus of claim 12, wherein the polarities of the liquid crystal cells in the first and second blocks are switched at every field.

18. The apparatus of claim 12, wherein each one of the first and second blocks includes at least two pixels, each pixel comprising liquid crystal cells corresponding to red, green, blue cells.

19. A liquid crystal display device, comprising:

a liquid crystal panel having picture elements and transistors connected to each of the picture elements, said picture elements being positioned at intersections in which a plurality of gate lines cross a plurality of source lines;

a gate driver, connected to the plurality of gate lines, that sequentially applies a scanning signal to the gate lines; and a source driver for supplying data voltages to the plurality of source lines in such a manner that the liquid crystal panel is divided into a plurality of blocks, that the polarities of data voltages applied to the picture elements adjacent to each other in the horizontal and vertical direction within each block are contrary to each other, and that a polarity arrangement of the data voltages applied between the blocks adjacent in the horizontal and vertical direction is contrary to each other.

20. A liquid crystal panel driving apparatus having liquid crystal cells arranged in a matrix pattern, the liquid crystal panel being divided into at least first and second blocks adjacent each other, the first block having at least two liquid crystal cells and including a first column and a last column, and the second block having at least two liquid crystal cells and including a first column and a last column, wherein the last column of the first block is adjacent the first column of the second block, the liquid crystal panel driving apparatus comprising:

drivers connected to the liquid crystal cells of the first and second blocks to drive each one of the liquid crystal cells;

a counter responsive to first and second input signals to output a carry signal; and a frequency controller responsive to the first and second input signals to generate first and second output signals;

an output controller connected to the counter and the frequency controller to generate an inversion control signal to the drivers so that the liquid crystal cells in the first column and the last column of the first block have alternating polarities with polarities of corresponding rows of liquid crystal cells in the first and last columns being opposite to each other, and the liquid crystal cells in the first column of the second block to have the same polarities as the corresponding liquid crystal cells located in the last column of the first block.

21. The liquid crystal panel driving apparatus of claim 20, wherein the first input signal is a vertical sync signal and the second input signal is a horizontal sync signal.

22. The liquid crystal panel driving apparatus of claim 20, wherein the counter is a modulo 4 type.

23. The liquid crystal panel driving apparatus of claim 20, wherein the frequency controller includes first and second flip-flops, the first flip-flop being responsive to the first and second input signals to generate the first output signal.

24. The liquid crystal panel driving apparatus of claim 23, wherein the second flip-flop is responsive to the first input signal to generate the second output signal.

25. The liquid crystal panel driving apparatus of claim 21, wherein the frequency controller includes first and second flip-flops, the first flip-flop being responsive to the vertical and horizontal sync signals to generate a frequency divided horizontal sync signal.

26. The liquid crystal panel driving apparatus of claim 25, wherein the second flip-flop is responsive to the vertical sync signal to generate a frequency divided vertical sync signal.

27. The liquid crystal panel driving apparatus of claim 20, wherein the frequency controller includes first and second flip-flops, the first flip-flop being responsive to the first and second input signals to generate the first output signal.

28. The liquid crystal panel driving apparatus of claim 20, wherein the output controller further generates an inverted inversion control signal.

* * * * *